US008336605B2

(12) United States Patent
Eriksson et al.

(10) Patent No.: US 8,336,605 B2
(45) Date of Patent: Dec. 25, 2012

(54) CONTINUOUS CASTING DEVICE

(75) Inventors: Jan-Erik Eriksson, Vasteras (SE); Eleonor Olsson, Vasteras (SE); Bengt Rydholm, Vasteras (SE); Helmut Hackl, Vasteras (SE)

(73) Assignee: ABB AB (SE)

( * ) Notice: Subject to any disclaimer, the term of this patent is extended or adjusted under 35 U.S.C. 154(b) by 317 days.

(21) Appl. No.: 12/472,937

(22) Filed: May 27, 2009

(65) Prior Publication Data

US 2009/0294091 A1 Dec. 3, 2009

(30) Foreign Application Priority Data

May 30, 2008 (EP) ..... 08157274

(51) Int. Cl.
*B22D 11/00* (2006.01)

(52) U.S. Cl. ..... 164/468; 164/504

(58) Field of Classification Search ..... 164/468, 164/503, 504, 466, 467, 502, 437
See application file for complete search history.

(56) References Cited

U.S. PATENT DOCUMENTS

| | | | | |
|---|---|---|---|---|
| 4,669,529 | A * | 6/1987 | Evertz | 164/443 |
| 4,749,026 | A | 6/1988 | Metz et al. | |
| 2006/0124272 | A1 * | 6/2006 | Galpin et al. | 164/502 |

FOREIGN PATENT DOCUMENTS

| | | | |
|---|---|---|---|
| GB | 705 762 | A | 3/1954 |
| JP | 61 115654 | A | 6/1986 |
| JP | 06 023498 | A | 2/1994 |
| JP | 07 108355 | A | 4/1995 |
| WO | 2005/002763 | A | 1/2005 |

OTHER PUBLICATIONS

European Search Report, Sep. 9, 2008, 4 pages.

* cited by examiner

*Primary Examiner* — Kevin P Kerns
*Assistant Examiner* — Steven Ha
(74) *Attorney, Agent, or Firm* — St. Onge Steward Johnston & Reens LLC

(57) ABSTRACT

A continuous casting device includes a mould, a nozzle, and an electromagnetic stirrer provided around the nozzle above the mould, the stirrer including a core of a magnetic material that extends circumferentially around the nozzle and a plurality of windings wound around the core. The windings are wound around a cross section of the core as seen in the circumferential direction of the core.

14 Claims, 3 Drawing Sheets

CONTINUOUS CASTING DEVICE

CROSS-REFERENCE TO RELATED APPLICATIONS

The present application claims priority of European patent application No. 08157274.5 filed on May 30, 2008, the content of which is incorporated herein by reference.

FIELD OF THE INVENTION

The present invention relates to a continuous casting device comprising a mould, a nozzle, and an electromagnetic stirrer provided around the nozzle above the mould, said stirrer comprising a core of a magnetic material that extends circumferentially around the nozzle and a plurality of windings wound around said core.

The present invention also relates to a continuous casting process for the casting of a metal, in which a metal is supplied through a tubular nozzle to a mould, and in which the metal flowing through the tubular nozzle is stirred by application of an electromagnetic field thereto, said electromagnetic field being generated by means of a stirrer comprising a core of a magnetic material that extends circumferentially around the nozzle and a plurality of windings wound around said core.

BACKGROUND OF THE INVENTION

Continuous casting of metals such as iron-based alloys such as steel is a well-known technology. During such casting a melt of the alloy in question is poured from a tundish through a tubular nozzle into a mould provided vertically below the tundish.

Normally, argon gas is injected into the melt in the nozzle at an upper part of the nozzle for different purposes, one of which is to effect the characteristics of the flow of the melt through the nozzle and thereby prevent clogging of the melt against the inner periphery of the nozzle. The argon gas then leaves the nozzle together with the metal. However, the motion of the argon gas when entering the melt in the mould is such that it might stay in the melt and form inclusions or slag in the strand that is continuously formed by said melt in the mould.

In absence of the injected argon gas, the tendency of metal clogging against the inner periphery of the nozzle is more evident. However also in presence of such injected gas there might be some tendency to metal clogging.

In order to solve this problem, prior art, as disclosed by WO 2005/002763 is suggested to use an electromagnetic stirrer for the purpose of stirring the melt that flows through the nozzle. The stirrer suggested in WO 2005/002763 comprises a ring-shaped iron core with poles that extend in a radial direction inwards towards the nozzle, and windings wound around said poles. A rotating magnetic field generated by means of the suggested stirrer will induce a stirring of the melt in the nozzle. Thereby the argon gas will become more concentrated to the centre of the melt in the nozzle since the centrifugal force will concentrate the more dense metal to the radial peripheral part of the melt. This, in its turn, results in a more concentrated flow of argon gas leaving the nozzle and being possible to direct to the upper surface of the melt residing in the mould. Thereby, less inclusions and slag generated by argon gas remaining in the melt is/are generated. Moreover, the helical flow path of the melt at the inner periphery of the nozzle further prevents clogging. However, the flow rate of the metal through the nozzle is high and the suggested design might not suffice to induce a sufficiently strong magnetic field in the melt for the purpose of achieving a fully satisfying result. The space for the poles around the nozzle is delimited due to the relatively small diameter of the latter, and, needless to say, the poles should be as close to the melt as possible in order to have a strong effect on the latter.

SUMMARY OF THE INVENTION

It is an object of the present invention to provide a continuous casting device as initially defined the design of which permits a sufficiently strong electromagnetic field to be generated in a melt flowing through the nozzle in order to overcome the above-mentioned problems.

There is also an object of the invention to present a continuous casting device the design of which results in an efficient transformation of electric power into a stirring force to which a melt in the nozzle is subjected.

The object of the invention is achieved by means of the initially defined continuous casting device, characterised in that said windings are wound around a cross section of the core as seen in the circumferential direction of the latter. In other words, the core extends in a circumferential direction around the nozzle, and the windings, i.e. the electrodes thereof, are wound in a generally radial direction with regard to the longitudinal axis of the nozzle. This design is more efficient than that of prior art, since it does not require the use of radial teeth that form poles extending towards the nozzle and since such teeth will become magnetically saturated such that they will inhibit the generation of a sufficiently strong magnetic field in the melt in the nozzle. Instead, the design of the invention will permit a very compact and efficient stirrer.

According to one embodiment, said windings generally cover the radial inner periphery of the core. Thereby, the best possible efficiency is achieved. It should be understood that the individual conductors of the windings are provided with an insulation, such that electric interference or short-circuits between windings of different electric phases are prevented.

According to a preferred embodiment, the windings define opposite poles on diametrically opposite sides of the nozzle. Thereby, a magnetic field traversing straight through the centre of the melt in the nozzle is achieved. It should be understood that a preferred embodiment comprises six windings, forming three pair of poles, one for each phase of an electric three phase system. However, the invention does not exclude other designs.

According to a further embodiment, the windings forming said opposite poles are connected to an AC current source that feed the said windings with an AC current with a frequency of at least 70 Hz. The torque generated by the stirrer on a melt in the nozzle is dependent of the frequency with which the poles of each phase is fed. Up to a certain frequency, of about 100 Hz, the torque increases. Therefore its is preferred that the frequency be above the normal electric power distribution frequency of 50 Hz or 60 Hz. Preferably, the windings forming said opposite poles are connected to an AC current source that feed the said windings with an AC current with a frequency of at least 90 Hz. Preferably, the frequency is below 120 Hz, or even below 110 Hz. These values are valid under precondition that the rotational speed of the magnetic field is substantially higher than the flow velocity of the melt through the nozzle and that the inner diameter or the distance between opposite parts of the inner periphery of the nozzle is in the range of 50-150 mm.

According to a preferred embodiment, the casting device comprises a tundish from which the nozzle extends to the mould, wherein the stirrer has a length in the longitudinal direction that corresponds to the distance between the tundish and the mould. In other words, the stirrer is arranged so as to make use of all the space available between the tundish and the mould in order to permit highest possible efficiency.

According to a further embodiment, the casting device comprises a cooling circuit that comprises cooling elements of an electrically conducting material provided between an inner periphery of the stirrer and an outer periphery of the nozzle, said cooling elements extending cross-wise to a longitudinal direction of the nozzle with a spacing between adjacent cooling elements in said longitudinal direction. The melt in the nozzle has a high temperature, higher than in the mould. Therefore, cooling of the stirrer from the inside is conceived. In order to prevent the upcoming of an induced current in the cooling elements that might seriously affect the strength of the electromagnetic field induced in the melt in the nozzle, the elements should be separated such that they are not continuous in the longitudinal direction of the nozzle, which is the same direction as the direction in which an electric current flows through the windings adjacent to the cooling elements.

According to a preferred embodiment said cooling elements comprise metal tubes with a cooling liquid flowing through said tubes. Preferably, the tubes are interconnected and follow an meander-shaped path around at least a part of the nozzle.

Preferably, the casting device comprises at least one electrically insulating element provided in said spacing between adjacent cooling elements. Such an insulating element will prevent the upcoming of any short circuit between adjacent cooling elements. Preferably, the electric insulating element is also a thermal insulation, preventing excessive heating of the stirrer, i.e. the windings and the core of the latter.

According to one embodiment, the casting device comprises a shield of an electrically conducting material provided outside the stirrer. Such a shield will counteract the extension of the magnetic field in a direction away from the melt. Thereby, less energy, i.e. electric power, is required in order to achieve a predetermined stirring of the melt in the nozzle, since a larger proportion of the energy used will in fact contribute to the generation of the magnetic field through the melt.

Preferably, said shield comprises at least one plate provided on the radial outside of the stirrer. Preferably, the plate defines a lateral plate that extends continuously around the stirrer, from the region of one end thereof to the other end thereof in the longitudinal direction of the nozzle. Thereby, a best possible dampening of the magnetic field in a radial direction away from the melt is achieved. It is preferred that the material of the plate be cupper.

According to a further embodiment, said shield comprises at least one plate provided opposite to and adjacent a longitudinal end of the stirrer. Since the magnetic field from the stirrer will also seek to extend in the longitudinal directions away from the stirrer, and such parts of the magnetic field will not contribute to any stirring of the melt but only result in higher energy consumption, it is suggested that dampening plates be provided on both opposite longitudinal ends of the stirrer. Likewise to any lateral plate, these end plates should be made of an electrically conducting material like cupper.

The object of the invention is also achieved by means of the initially defined casting process, characterised in that that said windings are wound around a cross section of the core as seen in the circumferential direction of the latter and that said windings are fed with an electric current. It should be understood that preferred embodiments of the process according to the invention are achieved by means of a continuous casting device in accordance with any of the embodiments thereof presented here.

Further features and advantages of the present invention will be presented in the following detailed description of a preferred embodiment of the continuous casting device of the invention.

BRIEF DESCRIPTION OF THE DRAWINGS

Hereinafter, an embodiment of the invention will be described by way of example with reference to the annexed drawing, on which.

DETAILED DESCRIPTION OF THE INVENTION

Figure 1:
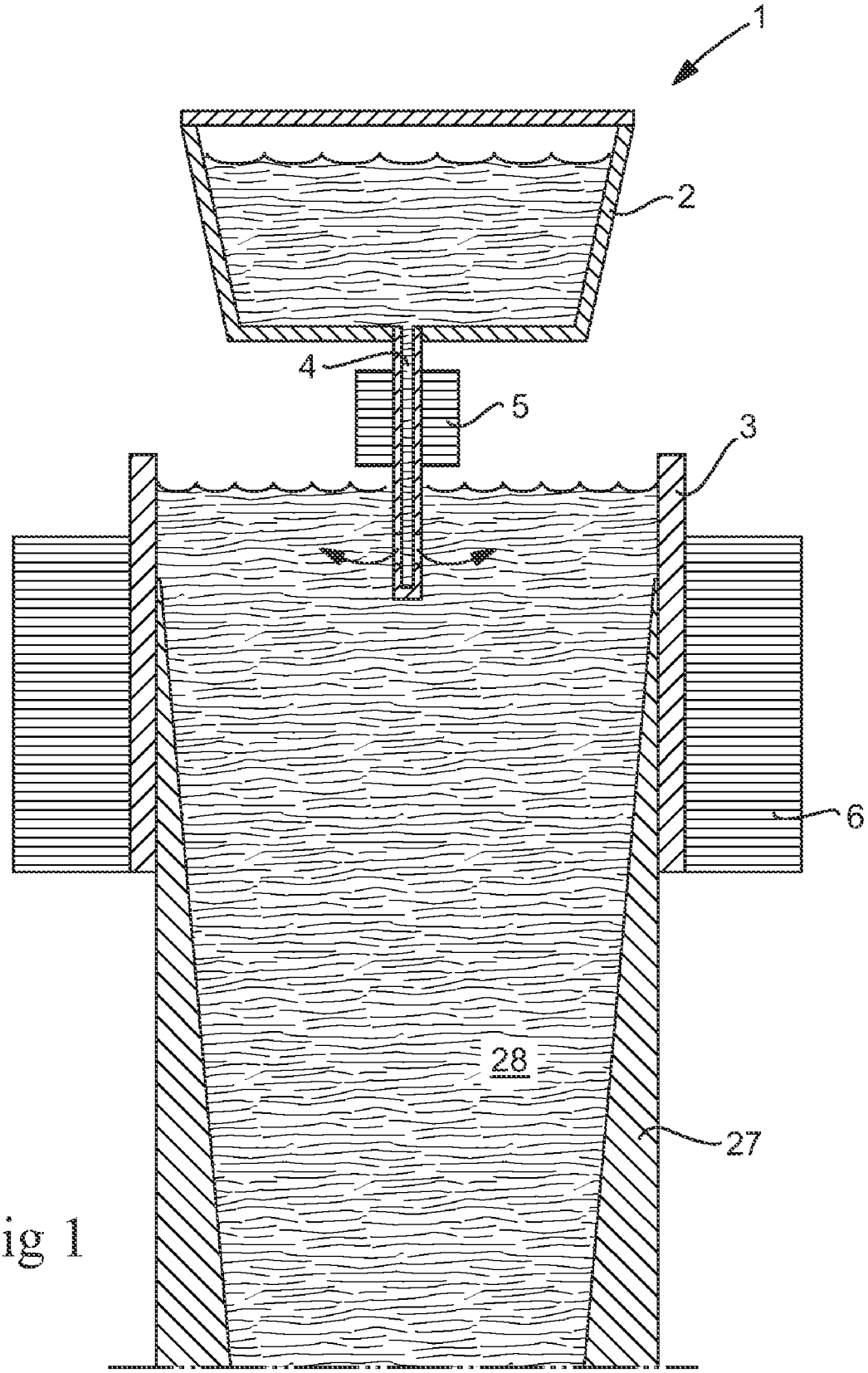
FIG. 1 is a cross sectional side view of a continuous casting device according to the invention.

FIG. 1 shows a continuous casting device 1 according to the invention. The casting device 1 comprises a tundish 2, a mould 3, a tubular nozzle 4 extending from the tundish 2 to the mould 3, and an electromagnetic stirrer 5 provided around the nozzle 4. The casting device 1 is used for the purpose of casting metals, preferably iron-based alloys such as steel. Thereby, molten metal is continuously supplied from the tundish 2 to the mould 3 through the nozzle 4. The molten metal travels through the nozzle 4 with a speed of above 1 meter/second, preferably in the range of 1-3 m/s. the distance from the tundish 2 to the mould 3 is less than 1 m, normally <0.4 m, or even <0.3 m. Accordingly, the height of he the stirrer 5, in its longitudinal direction, is delimited by said elements, and may be as low as <0.3 m. The width of he nozzle 4 is 50-150 mm. Here, the nozzle 4 has a circular cross section. Around the mould 3 there is provided a further electromagnetic stirrer 6 that, in a way known per see, operates on the melt in the mould. The further electromagnetic stirrer 6 is a well known accessory to this kind of devices and is therefore only briefly mentioned in this context.

The mould 3 is arranged so as to perform a short vertical reciprocating motion during the casting process. A strand of partially solidified metal (solidified part indicated with 27 in FIG. 1, molten part indicated with 28) is continuously exiting a lower opening in the mould 3 as the casting procedure goes on.

Figure 2:
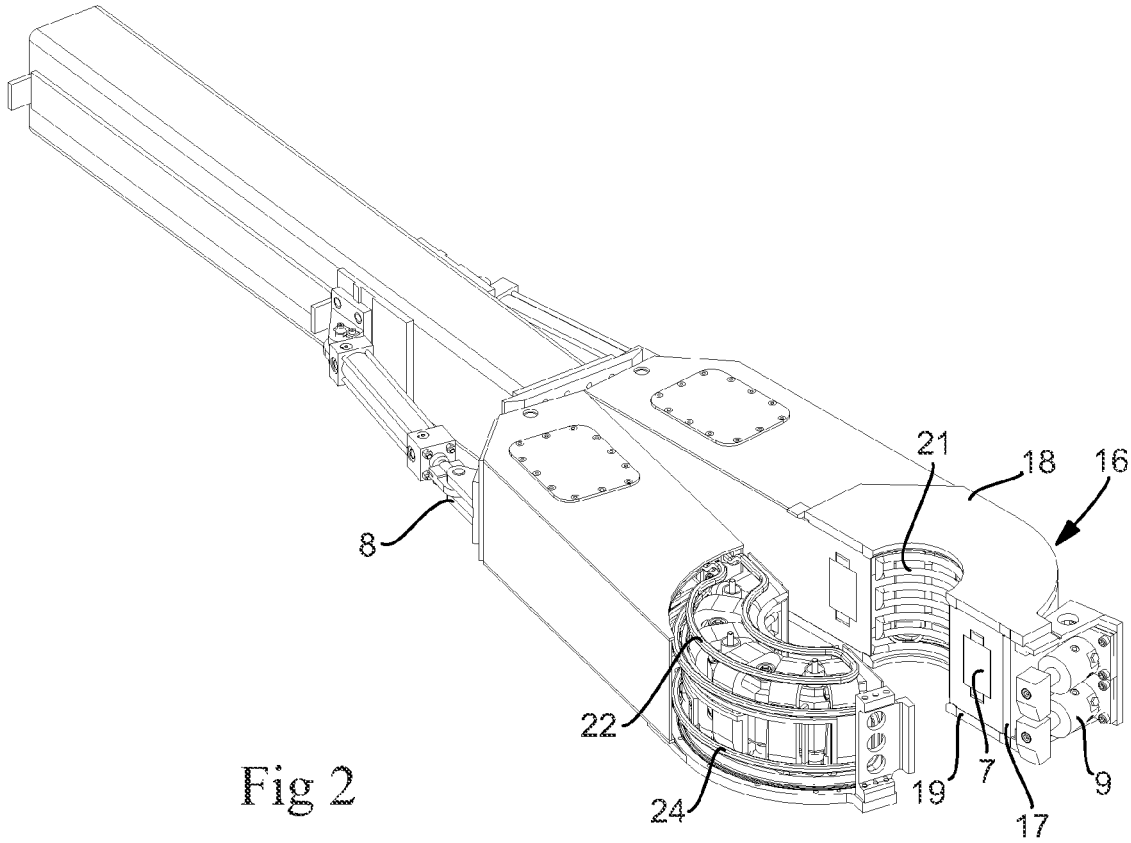
FIG. 2 is a perspective view of an electromagnetic stirrer according to the invention.

The electromagnetic stirrer 5 provided around the nozzle 4 comprises a generally cylindrical core 7 (see FIGS. 2-4), preferably made of iron. The core 7 is comprised by a plurality of segments that, together, form a circle or ring that has a generally circular outer circumference and a generally circular inner circumference as seen in a cross section from above (see FIG. 4). Each segment is comprised by a plurality of plates that have their main extension plain in a radial direction, i.e. horizontally, perpendicularly to the longitudinal direction of the stirrer 5. The plates of a single core segment are connected by means of a bolt 25 that extends perpendicularly to the main extension planes of the plates (see FIG. 3 in which, however, the individual plates are not shown). At the end of the bolt 25 there are provided electric insulation elements 26 by means of which the bolt 25 is electrically insulated from a winding that will be further described later. The core may also be provided with a dielectric insulation for the electric insulation thereof with regard to said windings. Generally, the cross section of the core 7, as seen in the longitudinal direction of the nozzle and, accordingly the stirrer 5, corresponds to the cross section of the tubular nozzle 4. As seen in FIG. 2, the stirrer may be subdivided in two parts that, through a hinge arrangement 8, are connectable to each other in order to tightly enclose the nozzle 4. There are also provided securing elements 9, here formed by hydraulic locking arrangements, by means of which the two parts of the stirrer 5 are held together in the operative position of the stirrer 5. In the operative position, the two parts of the core 7 are either pressed into contact with each other, or is the gap between them is kept at a minimum in order to minimize losses.

Figure 3:
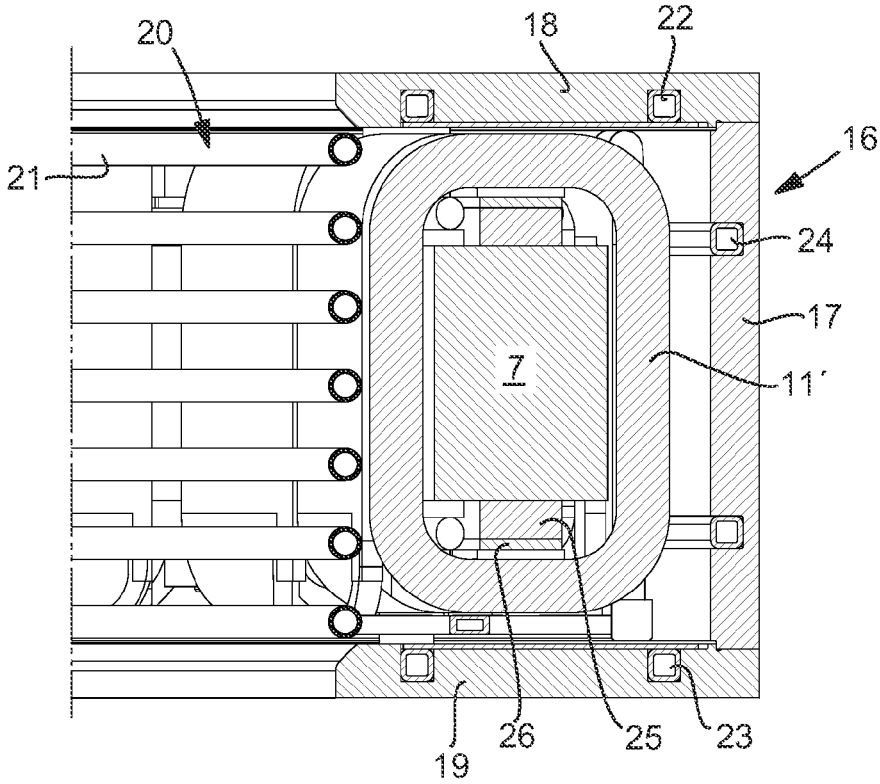
FIG. 3 is a cross section according to III-III in FIG. 4, as seen in circumferential direction through a part of the electromagnetic stirrer shown in FIG. 2.
Figure 4:
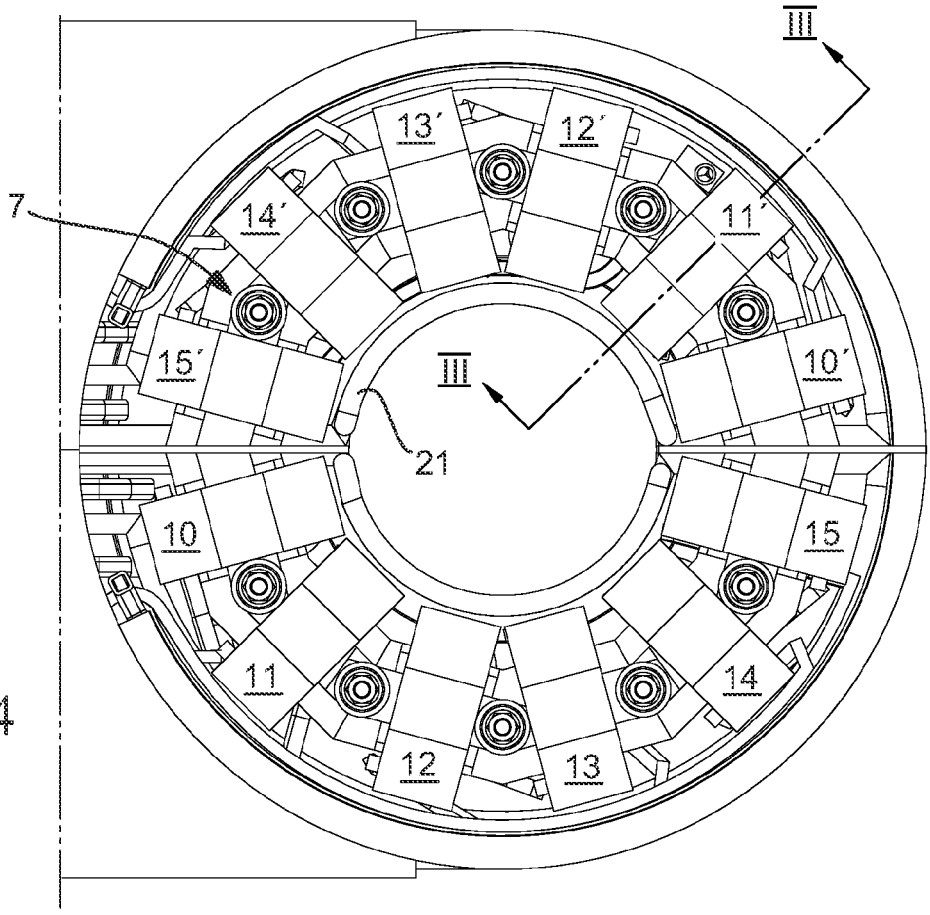
FIG. 4 is a top view of a part of the electromagnetic stirrer shown in FIGS. 2 and 3.

As can be seen in particular in FIGS. 3 and 4 there are provided windings 10-15, 10'-15' around the core 7. Pairs of the windings 10, 10'-15, 15' define opposite poles on diametrically opposite sides of the nozzle 4. Here, the device 1 comprises twelve windings 10-15, 10'-15', forming six pair of poles, two for each phase of an electric three phase system to which the casting device 1 is electrically connected. Each winding 10-15, 10'-15' is wound around a circumferential cross section of the core 7, thereby covering a predetermined section of the inner periphery thereof and extending to and covering a predetermined section of the outer periphery thereof. The windings 10-15, 10'-15' are arranged so close to each other that they cover essentially the whole inner periphery of the core 7, i.e. the periphery turned towards the tubular nozzle 4. Each winding 10-15, 10'-15' is connected to an electric power supply system by means of which it is fed with an AC current of approximately 100 Hz. Each winding comprises a wound electric conductor, preferably made of copper, covered by a dielectric insulation. Each conductor may be tubular, and may be fed with a cooling liquid, such as water, permitted to flow through the conductor.

There is provided a shield 16 of an electrically conducting material outside the stirrer 5 as seen in a radial direction from the nozzle 4. The shield 16 encircles the operative part of the electromagnetic stirrer 5, i.e. the core 7 and the windings 10-15, 10'-15' for the purpose of dampening and thereby enclosing the part of the electromagnetic field that will be direction outwards in a radial direction during operation of the electromagnetic stirrer 5.

The shield 16 comprises a plate or sheet 17 that, in accordance with the core 7 is subdivided in two parts connectable by means of the hinge arrangement 8 secured in relation to each other in the operative position of the device 1 by means of the securing elements 9. The shield 16, here the sheet 17 thereof, has a height corresponding to or slightly exceeding that of the core 7 that it encircles. It may be made of a suitable metallic material such as copper.

The shield 16 also comprises two end plates 18,19 provided opposite to and adjacent a respective longitudinal end of the operative part of the stirrer 5. Each of said plates is connected to the plate or sheet 17 that encircles the core 7 and windings 10-15, 10'-15'. Likewise to the latter, each end plate 18, 19 is also subdivided into two parts connectable by means of the hinge arrangement 8 secured in relation to each other in the operative position of the device 1 by means of the securing elements 9. Preferably, the end plates 18,19 are made of the same material as the encircling plate or sheet 17.

Inside the core 7 and the windings 10-15, 10'-15', as seen in radial direction towards the nozzle 4, there is provided a cooling circuit 20 that comprises cooling elements of an electrically conducting material provided between an inner periphery of the operative part of the stirrer 5 and an outer periphery of the nozzle 4, said cooling elements extending cross-wise to a longitudinal direction of the nozzle 4 with a spacing between adjacent cooling elements in said longitudinal direction. Here the cooling elements are formed by a continuous loop of a tube 21, preferably a copper tube, that follows a meander path. There is provided one such tube loop for each of the two halves into which the core 7 and the shield 15 are subdivided. In each such loop the main part of the tube 21 extends in the circumferential direction of the stirrer 5. In the longitudinal direction of the stirrer 5, i.e. the vertical direction thereof, there is a distance and a dielectric strength between the adjacently horizontally extending parts of the tube 21 of each loop such that no continuous induced current is generated in the elements, i.e. the tubes 21, of the cooling circuit 20 in a vertical direction as a response to the electric current flowing through the windings 10-15, 10'-15' in the opposite vertical direction at the part of the windings 10-15, 10'-15' that is applied on the inner periphery of the core 7. There are provided supply channels and exit channels (not shown in the figures) by means of which a cooling medium, preferably water, is supplied to an disposed from the tubes 21 of each of said loops of tubes.

As can be in FIGS. 2 and 3 there are provided further cooling elements 22, 23, 24 vertically above and below and outside the core 7 and windings 10-15, 10'-15' in a radial, horizontal direction. These cooling elements 22, 23, 24 are provided for the purpose of cooling the end plates 18, 19 and the encircling plate 17 respectively of the shield 16. Each of the cooling elements 22, 23, 24 comprises a tube of a material of high thermal conductivity such as a metal, connected to a supply channels (not shown) and disposal channels (not shown) by means of which a cooling medium such as water is supplied to and disposed from said elements after having passed through said elements 22-24.

The invention claimed is:

1. A continuous casting device comprising a mold, a nozzle, and an electromagnetic stirrer provided around the nozzle above the mold, said stirrer comprising a core of a magnetic material that extends circumferentially around the nozzle and a plurality of windings wound around said core, characterized in that said core comprises a portion having an essentially toroid shape and that said windings are wound around the portion in an essentially poloidal direction.

2. The continuous casting device according to claim 1, characterized in that said windings generally cover a radial inner periphery of the core.

3. The continuous casting device according to claim 1, characterized in that the windings define opposite poles on diametrically opposite sides of the nozzle.

4. The continuous casting device according to claim 3, characterized in that the windings forming said opposite poles are connected to an AC current source that feed said windings with an AC current having a frequency of at least 70 Hz.

5. The continuous casting device according to claim 3, characterized in that the windings forming said opposite poles are connected to an AC current source that feed said windings with an AC current having a frequency of at least 100 Hz.

6. The continuous casting device according to claim 1, characterized in that said device comprises a tundish from which the nozzle extends to the mold, and that the stirrer has a length in a longitudinal direction that corresponds to a distance between the tundish and the mold.

7. The continuous casting device according to claim 1, characterized in that said device comprises a cooling circuit that comprises cooling elements of an electrically conducting material provided between an inner periphery of the stirrer and an outer periphery of the nozzle, said cooling elements extending cross-wise to a longitudinal direction of the nozzle with a spacing between adjacent cooling elements in said longitudinal direction.

8. The continuous casting device according to claim 7, characterized in that said cooling elements comprise metal tubes with a cooling liquid flowing through said tubes.

9. The continuous casting device according to claim 1, characterized in that said device comprises a shield of an electrically conducting material provided outside the stirrer.

10. The continuous casting device according to claim 9, characterized in that said shield comprises at least one plate provided on a radial outside of the stirrer.

11. The continuous casting device according to claim 9, characterized in that said shield comprises at least one plate provided opposite to and adjacent a longitudinal end of the stirrer.

12. A continuous casting process for the casting of a metal, in which a metal is supplied through a tubular nozzle to a mold, and in which the metal flowing through the tubular nozzle is stirred by application of an electromagnetic field thereto, said electromagnetic field being generated by means of a stirrer comprising a core of a magnetic material that extends circumferentially around the nozzle and a plurality of windings wound around said core, characterized in that said core comprises a portion having an essentially toroid shape and that said windings are wound around the portion in an essentially poloidal direction.

13. The process according to claim 12, characterized in that said windings are fed with an AC current having a frequency of at least 70 Hz.

14. The process according to claim 12, characterized in that said windings are fed with an AC current having a frequency of at least 100 Hz.

* * * * *